United States Patent [19]

Baldacci et al.

[11] Patent Number: 4,968,291

[45] Date of Patent: Nov. 6, 1990

[54] STITCHING GEAR ASSEMBLY HAVING PERFORATING PROJECTIONS THEREON, FOR USE IN CONVERTER ADAPTED TO PRODUCE PAD-LIKE CUSHIONING MATERIAL, AND METHOD

[75] Inventors: Bruno H. Baldacci, Novelty; John E. Silvis, Fairport, both of Ohio

[73] Assignee: Ranpak Corp., Willoughby, Ohio

[21] Appl. No.: 346,783

[22] Filed: May 3, 1989

[51] Int. Cl.[5] ..... B31F 5/02; B31F 1/00; B31D 5/02

[52] U.S. Cl. ..... 493/354; 493/350; 493/390; 493/464

[58] Field of Search ..... 493/350, 354, 390, 394, 493/464

[56] References Cited

U.S. PATENT DOCUMENTS

| | | | |
|---|---|---|---|
| 2,107,462 | 2/1938 | Wood | 493/390 |
| 2,935,002 | 5/1960 | Robinson | 493/390 |
| 3,238,852 | 3/1966 | Schur et al. | 93/1 |
| 3,323,983 | 6/1967 | Palmer et al. | 162/362 |
| 3,509,797 | 5/1970 | Johnson | 93/1 |
| 3,655,500 | 4/1972 | Johnson | 161/104 |
| 3,898,920 | 8/1975 | Zucker | 493/390 |
| 4,026,198 | 5/1977 | Ottaviano | 93/1 WZ |
| 4,717,613 | 1/1988 | Ottaviano | 428/129 |
| 4,750,896 | 6/1988 | Komaransky et al. | 493/357 |

*Primary Examiner*—William E. Terrell

*Attorney, Agent, or Firm*—Calfee, Halter & Griswold

[57] ABSTRACT

A gear-like stitching assembly adapted for use in a converter mechanism of the type providing for the production of pad-like cushioning dunnage product from sheet-like stock material which is conventionally disposed in multi-ply, roll form for use with the converter mechanism. The stock material is pulled from the stock roll by the converter and the lateral edges of the stock material are rolled inwardly prior to being formed into the pad-like product. The stitching assembly comprises a pair of rotatable gear-like members adapted to be disposed in coacting, meshed condition, and to stitch confronting and generally abutting rolled edge portions of the sheet-like stock material together by coining, as the latter rolled edge portions pass between the members. The teeth of at least one of the members have projections extending outwardly thereform, for perforating the stock material along the central coined section of the pad-like product, to aid the coined section in maintaining the product in its pad-like form. A novel method is also disclosed.

18 Claims, 3 Drawing Sheets

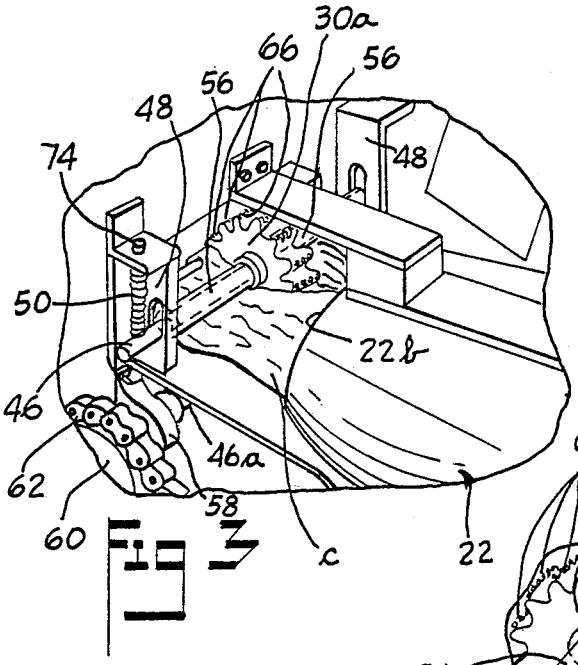
Fig 3
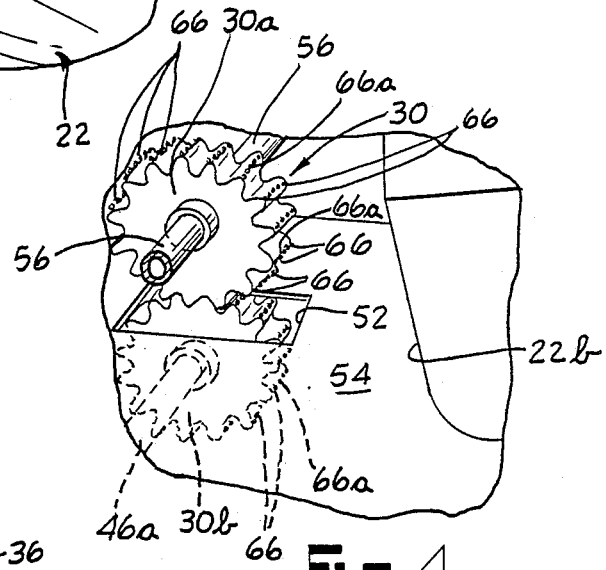
Fig 4
Fig 9
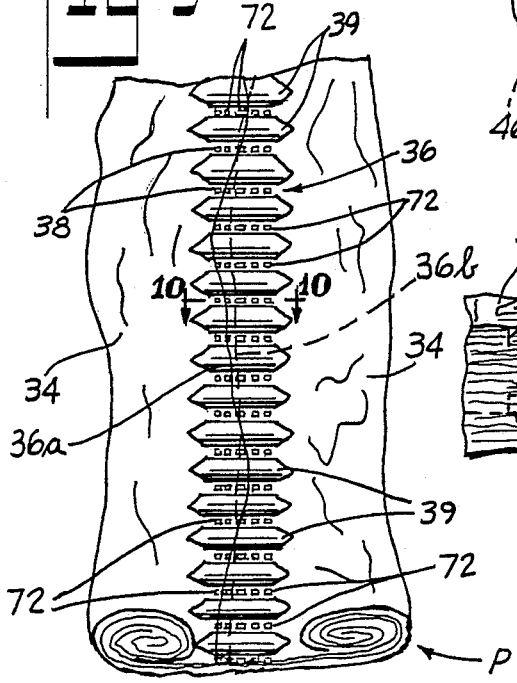
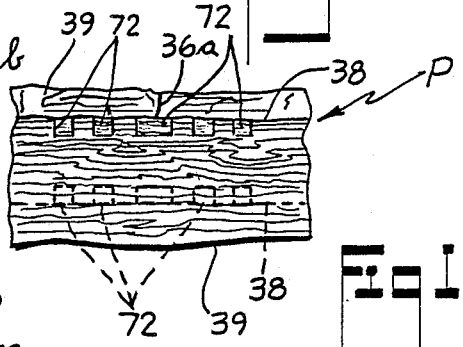
Fig 10

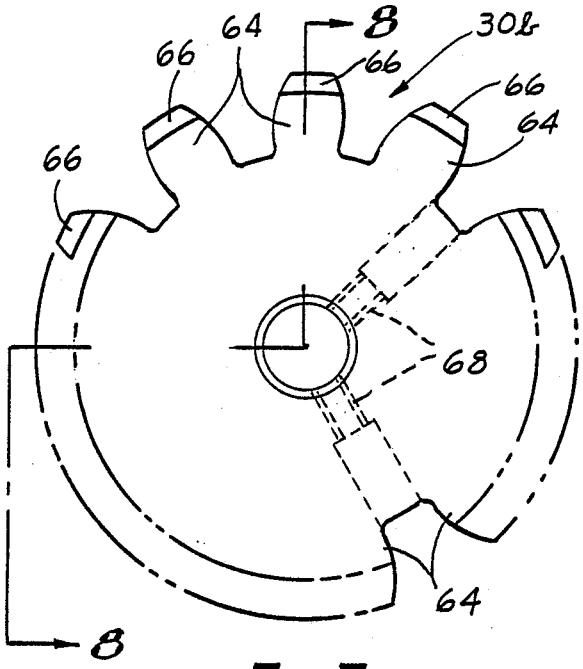
Fig 7
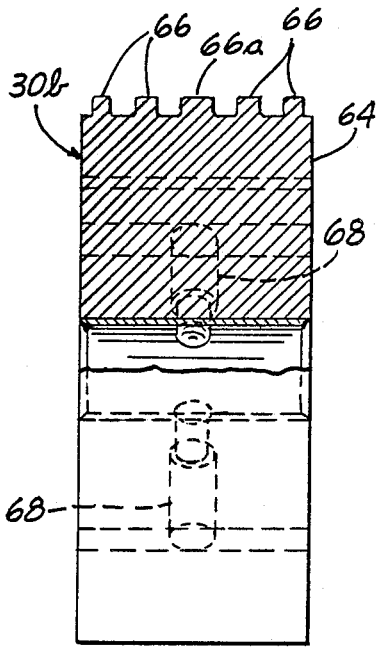
Fig 8
Fig 5
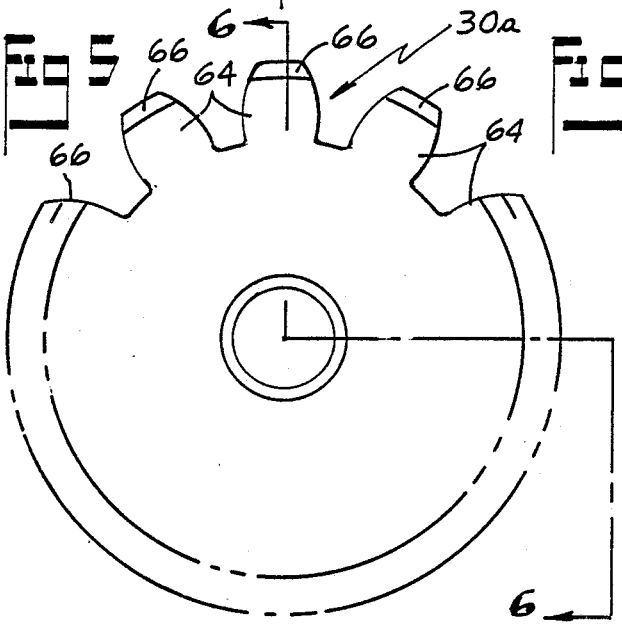
Fig 6
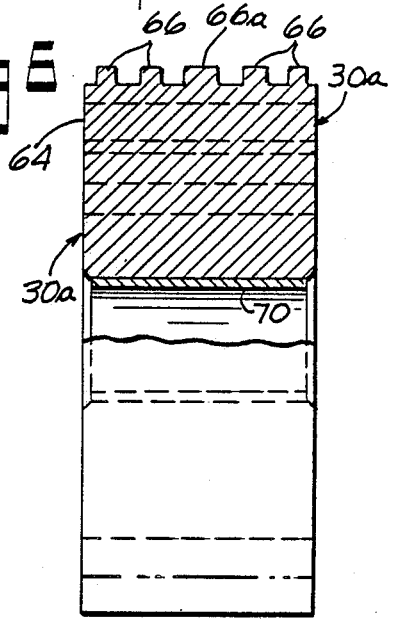

STITCHING GEAR ASSEMBLY HAVING PERFORATING PROJECTIONS THEREON, FOR USE IN CONVERTER ADAPTED TO PRODUCE PAD-LIKE CUSHIONING MATERIAL, AND METHOD

This invention relates in general to a gear-like stitching assembly adapted for use in a converter mechanism adapted for producing a packaging material or cushioning dunnage, as it is known in the art, and more particularly relates to a stitching assembly for dunnage producing converter mechanism utilizable for the production of a strip of resilient pad-like or pad-shaped dunnage product from sheet-like stock material, with the lateral edges of the sheet-like stock material being rolled inwardly as the stock material is pulled into the converter mechanism from a stock roll thereof, by means of the gear-like stitching assembly, and wherein the latter comprises a pair of coacting gear-like members adapted to stitch together by coining, confronting rolled edge portions of the sheet-like stock material to connect the same together along the central section of the pad-like product in a direction lengthwise thereof. The teeth of at least one of the gear-like members include projections thereon which are adapted to perforate the stock material along the central coined section of the produced pad-like product, to aid the coined section in maintaining the product in its pad-like form.

BACKGROUND OF THE INVENTION

Dunnage producing converter mechanism for producing resilient pad-like or pad-shaped cushioning dunnage product in strip-like form and having lateral pillow-like or pillow-shaped portions and a central connecting or joining section, running generally lengthwise of the strip of dunnage product, are well known in the art.

U.S. Pat. No. 4,750,896 dated June 14, 1988 to Anthony J. Komaransky, et al and entitled Method And Mechanism For Producing Cushioning Dunnage Product, discloses a cushioning dunnage converter or dunnage producing machine of the general type to which the present invention may be applied.

This type of converter mechanism is adapted to take sheets of stock material from a multi-ply stock roll, and pull them into the mechanism while generally turning or rolling the lateral edges of the sheet-like material inwardly, and then connecting the rolled, lateral confronting stock material sections thereof together along the central portion of the pad-like or pad-shaped product by coining, and then emitting the strip of cushioning dunnage product from the machine, with the produced cushioning product comprising relatively resilient, laterally spaced pillow-like or pillow-shaped sections or portions, and a generally centrally oriented coined, connecting portion or section, running generally lengthwise of the strip of product.

The connecting mechanism in the type of prior art converter machine previously identified may be a pair of coacting, generally vertically arranged, gear-like members or the like, which coin or deform the adjacent confronting edges of the lateral pillow-like sections of the pad-like product along the generally central section of the rolled edge strip of stock material, thus connecting together the lateral pillow-like or pillow-shaped sections, and resulting in the pad-like or pad-shaped dunnage product.

The product is adapted to be emitted through an exit opening in the converter machine, and a cutter mechanism is generally provided for severing the strip of cushioning product into selected length, for use in wrapping or packing parts, and the like.

In U.S. Pat. No. 4,717,613 dated Jan. 5, 1988 to Gary W. Ottaviano and entitled Mechanism And Method For Producing Cushioning Dunnage there is disclosed a dunnage converter mechanism which is operable to produce a pad-like cushioning dunnage product of the general type as that produced by the converter mechanism of the latter discussed Komaransky, et al patent.

There are a number of other prior art patents disclosing dunnage producing mechanism and methods for producing resilient pad-like or pad-shaped cushioning dunnage product of the same general type as that produced by the converter mechanism shown in the aforediscussed Komaransky, et al and the Ottaviano patents. Some of these are U.S. Pat. No. 3,655,500 dated Apr. 11, 1972 to G. R. Johnson and entitled A Resilient Cushioning Dunnage Product For Use In Packaging And Packing, and U.S. Pat. No. 4,026,198 to Gary W. Ottaviano dated May 31, 1977 and entitled Cushioning Dunnage Mechanism And Transfer Cart Therefor And Method, both of which disclose resilient pad-like or pad-shaped cushioning dunnage products comprising lateral generally resilient pillow-like or pillow-shaped portions connected along the central portion of the pad lengthwise thereof, together with methods and apparatuses for producing the same.

While coining and/or adhesive means have been utilized in these prior art arrangements, for connecting or holding the pillow-like or pillow-shaped portions of the pad-like or pad-shaped product together in pad-like form, to applicants' knowledge, no one prior to applicants has provided a stitching mechanism for use in a converter mechanism which includes perforating means for forming perforations in the produced pad-like product to aid in the holding or securement of the central connecting portion of the pad-like product, for more positively maintaining the pad-like or pad-shaped form of the product, and thus enhancing use and performance of the product.

SUMMARY OF THE PRESENT INVENTION

The present invention provides a gear-like stitching assembly for a dunnage producing mechanism or converter, which in addition to connecting together by coining, confronting rolled edge portions of sheet-like stock material, also causes perforation of the stock material along the central coined section of the produced pad-like or pad-shaped product, to aid the coined section in maintaining the product in its pad-like form. A novel method of producing the coined and perforated pad-like or pad-shaped product is also disclosed.

Accordingly, an object of the invention is to provide a novel stitching assembly for use in a dunnage producing mechanism or converter, which is capable of producing an improved pad-like or pad-shaped dunnage product having both a coined and perforated section running lengthwise of the product, for aiding in maintaining the product during use, in its pad-like or pad-shaped form.

Another object of the invention is to provide a novel dunnage producing or converter mechanism for producing cushioning dunnage for use as packing and/or packaging material, and the like.

Another object of the invention is to provide a mechanism or machine of the latter type which includes a gear-like stitching assembly which is operable to both coin and perforate confronting rolled edge portions of the sheet-like stock material during operation of the mechanism, for aiding in maintaining the produced pad-like product in its pad-like form especially during use of the product in packaging or packing, such as for instance in wrapping of parts or articles for shipment thereof.

A still further object of the invention is to provide a novel method of perforating a pad-like cushioning dunnage product along a coined, lengthwise extending central connecting section thereof to aid such coined connecting section in maintaining the pillow-like or pillow-shaped lateral sections connected, thus aiding in maintaining the pad-like or pad-shaped form of the produced cushioning dunnage product.

Other objects and advantages of the invention will be apparent from the following description taken in conjunction with the accompanying drawings wherein:

BRIEF DESCRIPTION OF THE DRAWINGS

FIG. 3 is an enlarged, fragmentary, perspective illustration of the converging member of the converter and the coacting meshed coining and perforating gear-like means of the stitching assembly for connecting the laterally arranged, generally abutting pillow-like portions of the dunnage product together, and illustrating the passage of the rolled edge stock material into the stitching assembly;

FIG. 4 is an enlarged fragmentary, perspective view of the meshed connecting gear-like members of the stitching assembly disposed adjacent the exit end of the converging member of the converter mechanism, and illustrating projections on the teeth of the gear-like members of the stitching assembly;

FIG. 5 is an enlarged, partially diagrammatic, side elevational view of the idler gear-like member of the stitching assembly;

FIG. 6 is a partial sectional view taken generally along line 6—6 of FIG. 5;

FIG. 7 is an enlarged, partially diagrammatic, side elevational view of the driven gear-like member of the stitching assembly;

FIG. 8 is a partial sectional view taken generally along line 8—8 of FIG. 7;

FIG. 9 is an enlarged diagrammatic, perspective plan view of a strip of the produced pad-like or pad-shaped cushioning dunnage product; and FIG. 10 is an enlarged, generally fragmentary, diagrammatic illustration taken generally along the plane of cross sectional line 10—10 of FIG. 9.

DESCRIPTION OF PREFERRED EMBODIMENT

Figure 1:
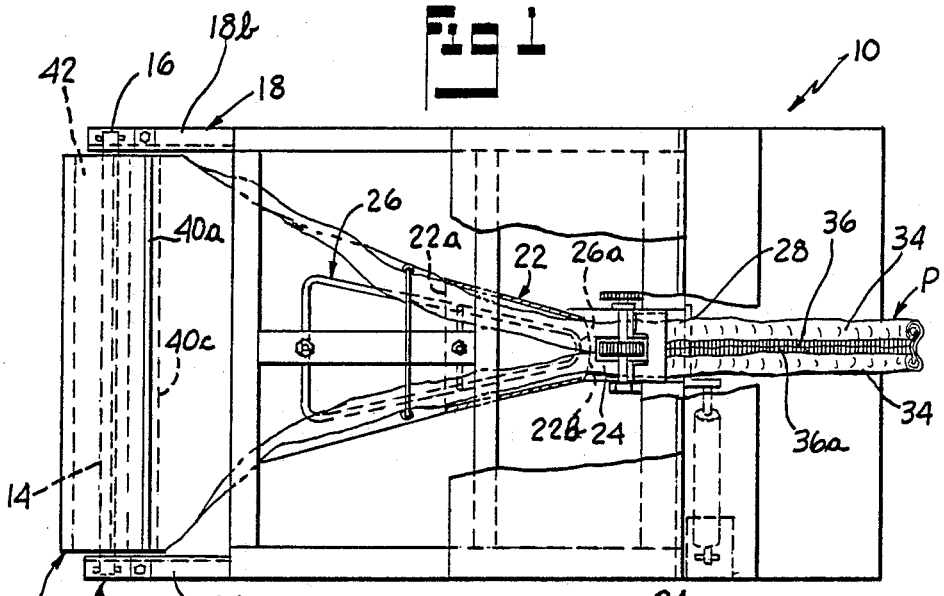
FIG. 1 is a partially broken, top plan view of a cushioning dunnage producing machine or converter, which embodies the invention.

Referring now again to the drawings, there is illustrated a dunnage producing machine 10, or converter as it is known in the art, which, in the embodiment illustrated, utilizes a multi-ply stock roll 12 of sheet-like stock material, such as, for instance, 30 pound kraft paper sheet. In the embodiment of stock roll illustrated in, for instance, FIGS. 1 and 2, the plies of the stock roll are preferably of equal width and in this embodiment comprise three plies disposed in roll form, for expeditious and compact installation on the dunnage producing machine or converter.

Stock roll 12, in the embodiment illustrated, comprises a hollow core 14 of generally cylindrical configuration on which the three super-imposed webs or sheets of stock material are wound. The stock roll is adapted to be mounted on a supporting rod 16 extending preferably relatively loosely through the core 14, for rotation of the stock roll 12 relative to the supporting frame structure 18 as the stock is drawn from the roll into the dunnage machine.

Reference may be had to aforementioned U.S. Pat. No. 4,750,896 which is incorporated herein by reference, for a more detailed explanation of the mounting of the stock roll on the converter. It will also be understood that the stock roll could be mounted on a separate stand or cart and the plies therein fed into the converter in a manner known in the art (e.g. U.S. Pat. No. 4,650,456 in the name of Steven E. Armington and issued Mar. 17, 1987).

Machine 10 in the embodiment illustrated, comprises an enclosed or sheathed support framework 20 including leg portions **20*a***, which may include means (not shown) associated therewith for leveling the support framework with respect to the supporting surface S.

Framework 20 supports a longitudinally converging chute-like member 22 (FIGS. 1 and 2) which chute or converging member forms a guide and support for the webs or plies of stock material as they are drawn off the stock roll 12 and are passed toward connecting or stitching mechanism section 24 of the dunnage producing machine.

Figure 2:
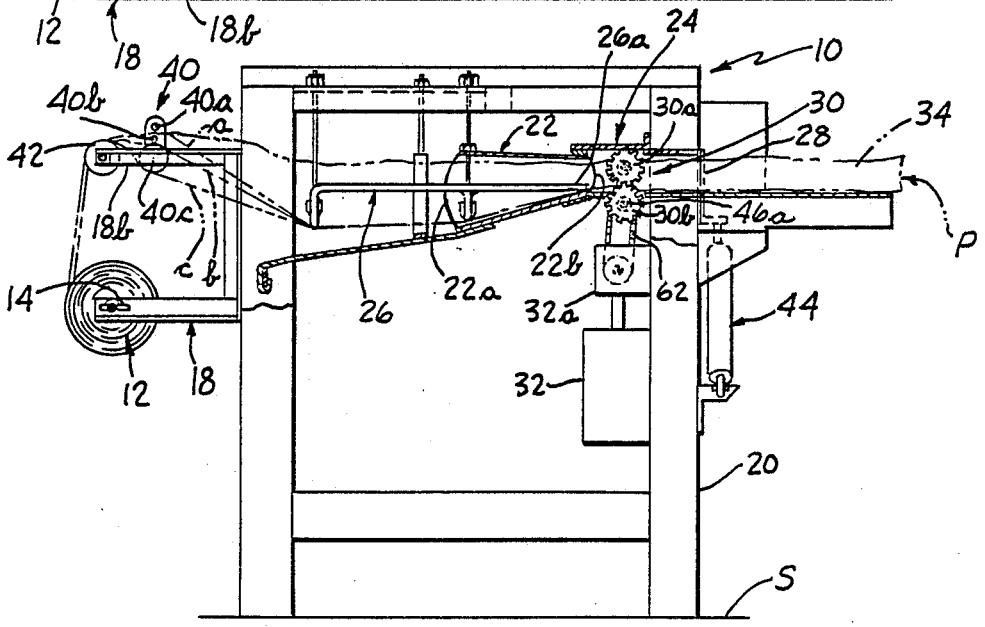
FIG. 2 is a partially broken, side elevational view of the machine of FIG. 1.

A three dimensional stock forming frame 26 which in the embodiment illustrated comprises a tubular frame body portion of generally triangular shape in plan (FIG. 1) is supported in the chute and projects rearwardly of the entry end **22*a* of the chute or converging member 22. Stock forming mechanism 26 at its forward nose end 26*a* is preferably disposed relatively close to the underlying bottom wall of the chute 22 adjacent the exit end 22*b* thereof, and as illustrated in FIGS. 1 and 2. The webs of stock material are adapted to move or slide between the nose end 26*a* and the chute exit end 22*b* during movement of the stock material from the stock roll 12 to the connecting or stitching section 24, which pulls the stock material through the machine, and causes discharge of the produced resilient dunnage pad product P through exit opening 28 in the machine frame 20**.

Connecting or stitching section 24 of the converter includes, in the embodiment illustrated, stitching assembly 30 comprising rotatable, generally loosely meshed gear-like members **30*a*, 30*b*, which are adapted to "coin" abutting lateral pillow-like or pillow shaped portions of the produced pad-like product, as the rotating gear-like members move the product through the converter and out exit opening 28. An electric motor and speed reducer mechanism 32, 32*a* may be utilized to drive one of the gear-like stitching members (i.e. member 30*b*) which because of its generally meshed relation with the other of said members (i.e. member 30*a*) likewise causes rotation of the latter. Reference may be had to aforementioned U.S. Pat. No. 4,750,896 for a more detailed disclosure of a converter mechanism, including pusher or forming frame mechanism 26 of the general type shown in FIGS. 1 and 2**, together with the operation thereof.

As the sheet-like stock material is pulled from the stock roll through the chute 22 by connecting or stitching mechanism 24, the side edges of the stock webs are rolled inwardly into generally spiral form and are urged inwardly toward one another so that the inwardly rolled edges form resilient pillow-like or pillow-shaped portions 34 (FIGS. 1, 2 and 9) of stock material disposed in generally abutting relationship as they merge from the exit end of the chute-like member 22 and pass into the rotatable connecting or stitching section 24 of the converter mechanism where such inwardly rolled edges of the stock material are adapted to be joined or stitched together lengthwise of the produced dunnage product, by the rotating gear-like members 30*a*, 30*b* thus resulting in a generally central coined section 36 on the product extending lengthwise of the pad-like product, and stitching together (FIGS. 1 and 9) the compressed, overlapped abutting coined edges 36*a* and 36*b* (FIG. 9) of the formed pillow-like portions of the pad-like or pad-shaped product. The latter edges 36*a*, 36*b* are generally disposed in generally random overlapped relation as illustrated, along the central compressed coined connecting section 36 of the produced pad-like product.

The laterally arranged pillow-like or pillow-shaped portions 34 of the pad-like cushioning product possess considerable resiliency, each being of a substantially greater thickness than the compressed central coined portion 36. The coining of the product by the gear-like members 30*a*, 30*b* produces flat or valley sections 38 with intermediate rise sections 39, with the rise sections projecting outwardly from the level of the associated flat or valley sections, and as clearly shown for instance in FIG. 10.

Referring now in particular to FIGS. 1 and 2, there is provided at the forward end of the embodiment of converter machine illustrated, a separating mechanism 40 which is adapted to receive the sheet-like stock material from the stock roll 12 and to separate the multi-plies of the roll into individual plies or webs of stock material prior to their passing beneath the forming frame 26 and into the converging chute-like member 22, thus aiding in maintaining the resiliency of the produced dunnage product P. Separating means 40 in the embodiment illustrated, comprises a plurality of vertically spaced, generally horizontally oriented cylindrical bar-like elements 40*a*, 40*b* and 40*c* about which is adapted to pass the respective web a, b and c of the stock material from the rotatable stock roll, prior to passage thereof underneath the forming frame 26 and into converging chute member 22.

As can be best seen in FIG. 2, the lower transverse bar-like member 40*c* is preferably of a materially greater thickness or diameter as compared to those of the upper bar-like members 40*a* and 40*b*, with member 40*c* preferably being rotatably mounted on the upper arm 18*b* of the respective support bracket 18. Members 40*a*, 40*b* and 40*c* are all preferably rotatable with respect to their mounting structure.

The arrangement of the stock material webs a, b and c with respect to the separating bars 40*a*, 40*b* and 40*c* are preferably as shown in FIG. 2. Webs b and c both may engage roller 40*c* while web a passes over rotatable bar 40*b* as shown in FIG. 2. The rotatable mounting of elements 40*a*, 40*b* and 40*c* aids in preventing tearing of the sheet or web stock material in its passage through the machine.

Disposed outwardly from separating mechanism 40 and also supported on upper arm 18*b* is preferably a further bar member 42 which in the embodiment illustrated is a rotatable roller having a cylindrical exterior surface, with the ends of roller 42 being rotatably mounted directly on the spaced upper arms 18*b* of U-brackets 18.

Roller member 42 provides a non-varying point of entry of the plies of sheet-like stock material from the stock roll 12, as they (the plies) are pulled into the dunnage producing mechanism toward the separating means 40, and irrespective of the diameter of the stock roll. Thus in the event of utilizing a larger diameter roll, or as the stock roll is used up during operation of the converter mechanism, the point of entry of the material toward the separating means remains constant, thus facilitating a more uniform production of dunnage pad product from the mechanism. Reference may be had to aforementioned U.S. Pat. No. 4,750,896 for a more detailed description of separating mechanism 40 and associated common entry point member 42.

After passing through the exit opening 28 of the converter, the continuously formed pad-like product P is adapted to be severed by a cutter mechanism 44 mounted on the converter machine generally adjacent the exit opening 28, to cut the strip of produced dunnage product into desired lengths.

Referring now in particular to FIGS. 3 and 4, the generally loosely meshed, substantially vertically arranged gear-like members 30*a*, 30*b* are rotatably mounted as by means of a respective shaft 46, 46*a*. Shaft 46 of the upper idler gear-like member 30*a* is preferably arranged with the ends of the shaft being mounted in slotted bracket frames 48 (FIG. 3) and with both of the ends of the shaft being spring loaded as at 50, for urging shaft 46 and associated gear-like member 30*a* downwardly toward the underlying gear-like member 30*b*. It will be seen therefore that the top member 30*a* which is rotatable relative to its supporting shaft 46 generally "floats" due to supporting slotted bracket structure 48 with member 30*a* and associated shaft 46 being movable vertically relative to the underlying member 36*b*, to thus provide for automatic varying of the space between the teeth of the gear-like members in the event of varying amounts or thicknesses of the sheet-like stock material attempting to pass therebetween during the connecting or stitching operation. Such arrangement aids in preventing tearing of the stock material due to too hard "meshing" between the gear-like members of the stitching assembly 30. As can be best seen in FIG. 4, the underlying driven gear-like member projects upwardly through a slot or opening 52 in generally horizontal support plate 54, which extends between the chute member 22 and the product exit opening 28 of the dunnage producing machine.

Shaft 46 is preferably provided with roller sleeves 56 (FIGS. 3 and 4) on both sides of the gear 30*a* so that as the crumpled rolled edge stock material emerges from the exit end 22*b* of the chute member 22, it passes beneath the shaft 46 and associated roller sleeves 56 which are rotatable relative to the shaft, and thus aid in preventing tearing of the pad-like product as the connecting or stitching assembly 30 coins the generally central portion of the strip of product, and connects the lateral pillow-like sections 34 thereof together, as illustrated for instance in FIG. 9, prior to emergence of the finished product from the machine.

The underlying connector gear-like member 30*b* is keyed or fixed to its shaft 46*a*, the latter being rotatably mounted at its ends in bearing structure 58, and may include a sprocket 60 secured adjacent one end of shaft 46*a*, and which sprocket 60 in turn is connected as by an endless chain or belt to aforementioned geared speed reducer 32*a*.

FIGS. 5–8 illustrate enlarged detail views of gear-like members 30*a*, 30*b*, wherein such members are basically spur gears with the teeth 64 thereof embodying the 14½ Deg. Involute System. In accordance with the invention however, the teeth have been cut or formed to provide projections 66, 66*a* thereon, with such projections being spaced laterally of one another in a direction transverse of the tooth (FIGS. 6 and 8). The central projection 66*a* in each row of projections is preferably of a greater width as compared to the width of each of the other projections 66 in the respective row of projections, and as illustrated.

The driven gear-like member 30*b*, in the embodiment illustrated, has threaded openings 68 formed therein for receiving threaded set screws (not shown) for fixing or locking the member 30*b* to its associated shaft 46*a*. The idler gear 30*a* is rotatable with respect to its associated shaft 46, and may be provided with a sleeve bearing 70 for facilitating rotation of gear 30*a* with respect to shaft 46.

During rotation of the gears as aforedescribed in connection with operation of the converter mechanism, the projections 66, 66*a* on the teeth simultaneously with the coining of the central section 36 of the produced product, pierce or perforate the underlying compressed stock material to form spaced openings disposed transverse of the central connecting section 36 of the product, and extending in a direction lengthwise of the product, to aid the coined portions in maintaining the product in its pad-like or pad-shaped form, thus facilitating the use of the product as packing or packaging material. In other words, the perforations 72 (FIGS. 9 and 10) stake the compressed stock material together along the central connecting section 36 of the product, and aid the coined portions in preventing opening up or separation of the connecting section of the product.

A force of approximately 10 pounds is preferred as applied by each spring unit 50 to shaft 46, to thus resist movement of the idler member 30*a* away from the driven member during the stitching operation by the stitching assembly 30. However, means 74 is preferably provided coacting with each spring unit 50, for varying the pressure applied to the shaft by the respective spring unit. If for instance heavier webs or sheets of stock material are utilized for the stock material, then the adjusting means 74 can be turned or actuated to increase the force or pressure for obtaining satisfactory coining- and perforation or piercing of the central connecting section of the product. However, for the usual tri-ply, 30 pound kraft paper stock roll utilized in connection with the converter to form the produced product, a set-up or pre-applied pressure of approximately 10 p.s.i. for each spring unit 50 is preferred.

From the foregoing discussion and accompanying drawings it will be seen that the invention provides a novel stitching assembly useable in different types of cushioning dunnage producing machines or converters which includes means for perforating or piercing the stock material along the central connecting section of the produced pad-like cushioning product, for aiding the coined section of the product in maintaining the product in its pad-like form. The invention also provides a novel converter mechanism embodying a stitching assembly of the latter type, as well as a novel method of producing pad-like cushioning dunnage material from web-like or sheet-like stock material.

The terms and expressions which have been used are used as terms of description and not of limitation, and there is not intention in the use of such terms and expressions of excluding any equivalents of any of the features shown or described, or portions thereof, and it is recognized that various modifications are possible within the scope of the invention claimed.

I claim:

1. A stitching assembly adapted for use in a converter mechanism which produces pad-like cushioning dunnage product from sheet-like stock material disposed in stock roll form, the converter being operable to cause inward rolling of the lateral edges of said stock material into generally rolled form prior to being formed into the pad-like product, said stitching assembly comprising means for receiving generally abutting rolled edge portions of said stock material, to connect the same together along the generally central section of the produced pad-like product in a direction lengthwise thereof, and for pulling said stock material through the converter and causing its discharge as produced pad-like product therefrom, said stitching assembly comprising:

a pair of rotatable, toothed-wheel gear members adapted to be disposed in meshed condition and to stitch confronting rolled edge portions of said stock material together by coining as the latter rolled edge portions pass between said members, and characterized by the teeth of at least one of said members having projections thereon for perforating the stock material along the central coined section of produced pad-like cushioning dunnage product, to aid the coined section in maintaining the product in its pad-like form.

2. A stitching assembly in accordance with claim 1 including means providing for movably mounting one of said toothed-wheel gear members with respect to the other of said members for providing for to and from movement of the toothed-wheel gear members relative to one another during the stitching operation.

3. A stitching assembly in accordance with claim 1 wherein said projections comprise a plurality of spaced projections on the tops of each of the teeth of said one member oriented with respect to one another in a direction transverse of the respective tooth of said one member.

4. A stitching assembly in accordance with claim 3 wherein each of said spaced projections is of a greater dimension in a direction lengthwise of the one member as compared to the direction transverse of said one member.

5. A stitching assembly in accordance with claim 3 wherein said spaced projections on each tooth comprise one projection disposed generally coplanar with the vertical longitudinal center plane of the one member and other projections being spaced laterally of said plane and of said one projection on opposite sides thereof.

6. A stitching assembly in accordance with claim 1 wherein said members are spur gears, with the teeth of each said member having said projections thereon.

7. A stitching assembly in accordance with claim 1 including a mounting shaft for each said members.

8. A stitching assembly in accordance with claim 7 wherein the shaft for one of said members is non-movably connected thereto while said shaft for the other of said members is rotatable relative to said other member, and thus the latter is on idler.

9. A stitching assembly in accordance with claim 6 wherein the gear teeth embody the 14½ Deg. Involute System and each said spur gear embodies eleven teeth.

10. In a converter mechanism for producing pad-like cushioning dunnage product from sheet-like stock material comprising a support, means on said support for causing inward rolling of the lateral edges of the stock material into generally rolled form, and stitching means on the support adapted to receive confronting rolled edge portions of said stock material, to connect the same along the generally central section of the produced pad-like product in a direction lengthwise thereof, and to pull the stock material through the converter and to cause its discharge as said pad-like product therefrom, said stitching means comprising:

a pair of spaced meshed, rotatable toothed-wheel members adapted to stitch confronting rolled edge portions of said stock material together by coining as such rolle dedge portions pass between said members, and wherein the teeth of at least one of said members have projections thereon for perforating the stock material along the central coined section of the produced cushioning dunnage product, to aid the coined section in maintaining the product in its pad-like form.

11. A converter mechanism in accordance with claim 10 wherein said stitching means includes means providing for movably mounting one of said members relative to the other of said members in directions toward and away from one another, thus providing for relative generally linear movement of said members relative to one another.

12. A converter mechanism in accordance with claim 11 wherein said stitching means includes spring means coacting with the last mentioned said one member for resisting said linear movement in at least one of said directions.

13. In a method for producing cushioning dunnage product in pad-like form from sheet-like stock material and wherein the product comprises lateral pillow-like portions connected by a central section extending lengthwise of the product, comprising taking at least one web of said stock material and moving it longitudinally while rolling the lateral edges of the web inwardly into generally spiral form and causing such inwardly rolled edge portions to be disposed into generally abutting condition, and then connecting the rolled edge portions together by lengthwise coining thereof along the juncture of said rolled edge portions and transversely of the pad-like product to form the centrally connecting section of the product, and including the step of perforating the stock material along the central connecting section to aid in connecting the lateral rolled edge portions together.

14. A method in accordance with claim 13 wherein said cushioning and said perforating are done substantially simultaneously.

15. A method in accordance with claim 13 wherein said coining is accomplished by providing a pair of meshed toothed-wheel gear members, which pull the stock material into the members and cause discharge of said product therefrom, through which said rolled edge portions are passed to connect said rolled edge portions together by said coining, and providing projections on the teeth of said members to cause said perforation of the stock material along said central coined section during passage of said abutting rolled edge portions through said members.

16. A method in accordance with claim 13 including providing for to and from movement of the toothed-wheel gear members relative to one another during the connecting operation to aid in preventing tearing of the stock material, while applying a force of approximately 10 pounds to the movable toothed-wheel gear member on each side thereof to resist its movement away from the other toothed-wheel gear member.

17. A method in accordance with claim 13 including the step of providing a predetermined width multi-ply roll of the sheet-like stock material and mounting it for rotation about its axis of curvature prior to said moving of the sheet-like stock material longitudinally.

18. A method in accordance with claim 17 including providing three plies of the sheet-like stock material in said roll form.

* * * * *